US010577862B2

(12) United States Patent
Khan

(10) Patent No.: US 10,577,862 B2
(45) Date of Patent: Mar. 3, 2020

(54) ENTERTAINMENT AND GATING ASSEMBLY

(71) Applicant: Aisha Khan, Houston, TX (US)

(72) Inventor: Aisha Khan, Houston, TX (US)

( * ) Notice: Subject to any disclaimer, the term of this patent is extended or adjusted under 35 U.S.C. 154(b) by 161 days.

(21) Appl. No.: 15/814,698

(22) Filed: Nov. 16, 2017

(65) Prior Publication Data

US 2019/0145168 A1 May 16, 2019

(51) Int. Cl.

| | |
|---|---|
| ***E06B 11/02*** | (2006.01) |
| ***E05B 65/00*** | (2006.01) |
| *A63H 33/00* | (2006.01) |
| *E06B 9/00* | (2006.01) |

(52) U.S. Cl.

CPC ..... *E06B 11/022* (2013.01); *E05B 65/0007* (2013.01); *E05B 65/0014* (2013.01); *A63H 33/006* (2013.01); *E06B 2009/002* (2013.01)

(58) Field of Classification Search

CPC ..... E06B 2009/002

See application file for complete search history.

(56) References Cited

U.S. PATENT DOCUMENTS

| | | | | |
|---|---|---|---|---|
| 4,664,640 | A | 5/1987 | Shindo et al. | |
| 4,973,286 | A | 11/1990 | Davison | |
| D370,942 | S | 6/1996 | Arad et al. | |
| 5,709,582 | A | 1/1998 | O'Donnell | |
| 6,711,854 | B1 * | 3/2004 | Andersen | E06B 9/02 49/50 |
| 7,178,792 | B2 * | 2/2007 | Monahan | E06B 9/08 160/10 |
| 8,381,334 | B2 | 2/2013 | Ballard | |
| 8,607,503 | B2 * | 12/2013 | Ivie | E06B 9/04 49/55 |
| 9,267,323 | B2 * | 2/2016 | Whooley | E06B 9/02 |
| 9,415,323 | B2 * | 8/2016 | Austern | A63H 33/003 |
| 9,713,776 | B1 * | 7/2017 | Leung | A63H 33/006 |
| 9,985,676 | B2 * | 5/2018 | Fathollahi | H04B 1/3833 |
| 2007/0084332 | A1 * | 4/2007 | Blaszczyk | A63H 5/00 84/600 |
| 2012/0325881 | A1 * | 12/2012 | White | A63H 33/006 224/581 |
| 2015/0097349 | A1 | 4/2015 | Johnson | |
| 2015/0105608 | A1 * | 4/2015 | Lipoma | A61B 5/6896 600/27 |
| 2016/0096116 | A1 * | 4/2016 | Dunn | A63H 33/006 446/227 |
| 2016/0230449 | A1 * | 8/2016 | Robertson-Sharma | A47D 13/06 |

* cited by examiner

*Primary Examiner* — Catherine A Kelly

(57) ABSTRACT

An entertainment and gating assembly for sequestering and entertaining a child includes a gate that is configured to selectively couple to opposing elements of a structure that define an opening, such as jambs of a door, to selectively retain a child within a portion of the structure. At least one entertainment module is coupled to the gate. The at least one entertainment module is configured to entertain the child who is retained in the portion of the structure.

15 Claims, 4 Drawing Sheets

ENTERTAINMENT AND GATING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to gating assemblies and more particularly pertains to a new gating assembly for sequestering and entertaining a child.

BRIEF SUMMARY OF THE INVENTION

An embodiment of the disclosure meets the needs presented above by generally comprising a gate that is configured to selectively couple to opposing elements of a structure that define an opening, such as jambs of a door, to selectively retain a child within a portion of the structure. At least one entertainment module is coupled to the gate. The at least one entertainment module is configured to entertain the child who is retained in the portion of the structure.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
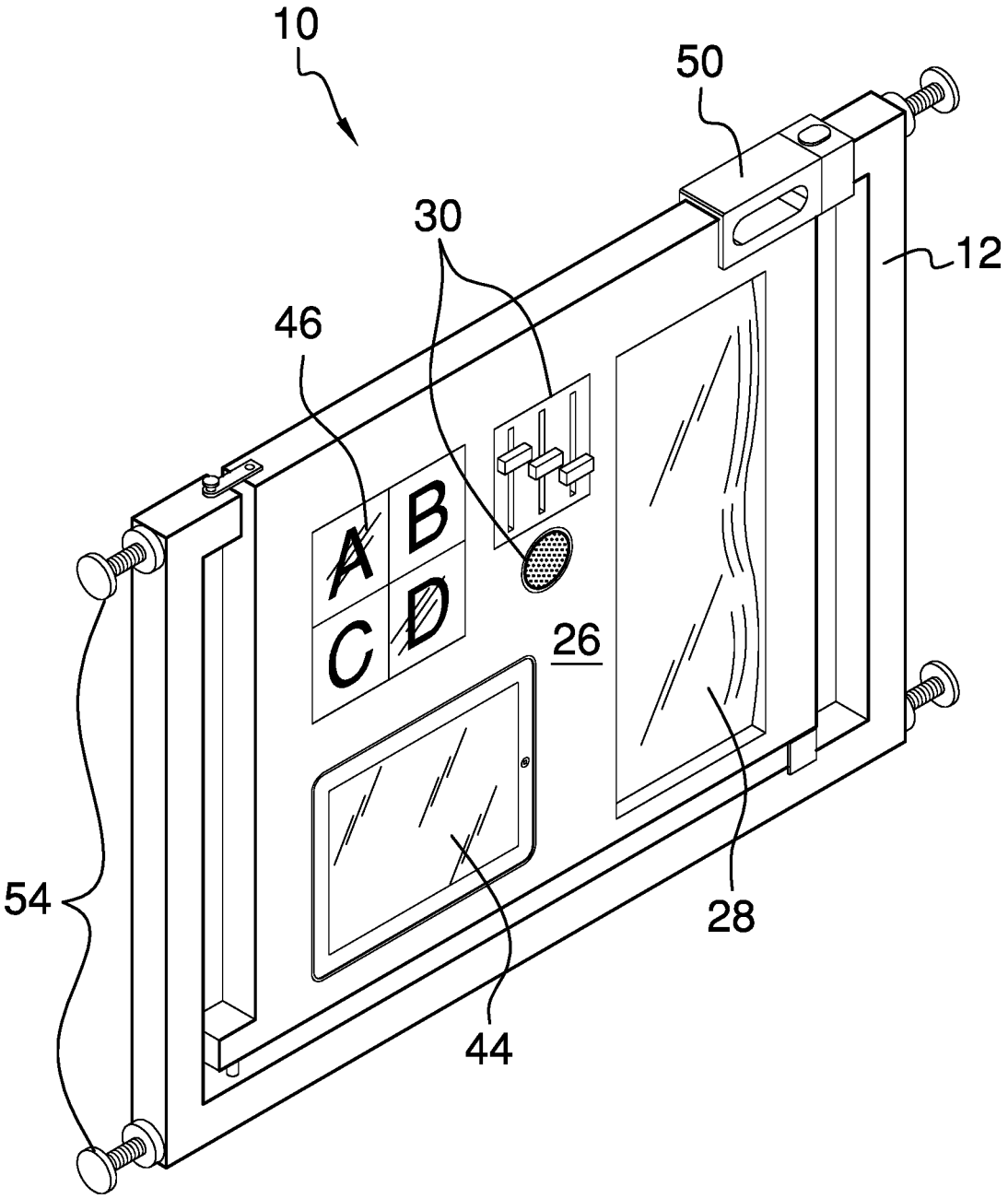
FIG. 1 is an isometric perspective view of an entertainment and gating assembly according to an embodiment of the disclosure.
Figure 2:
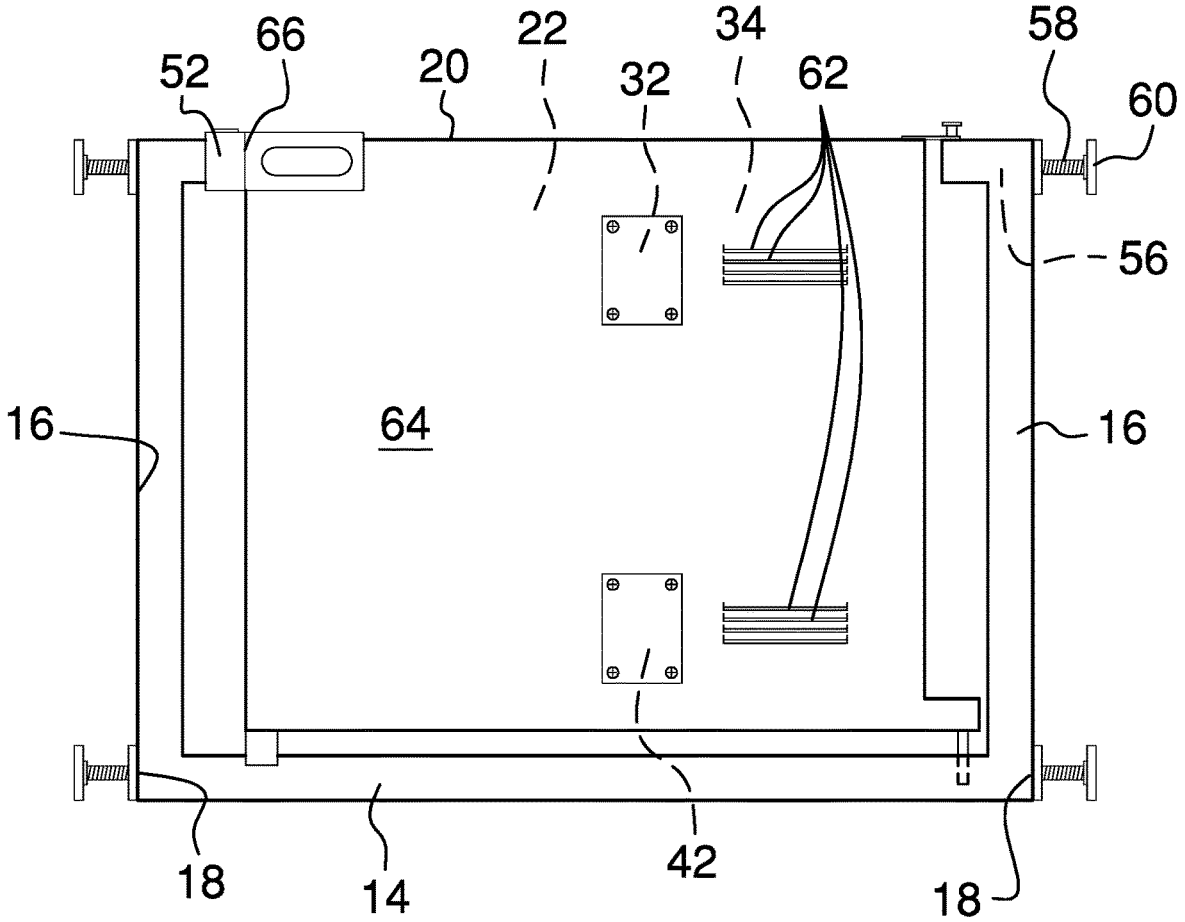
FIG. 2 is a back view of an embodiment of the disclosure.
Figure 3:
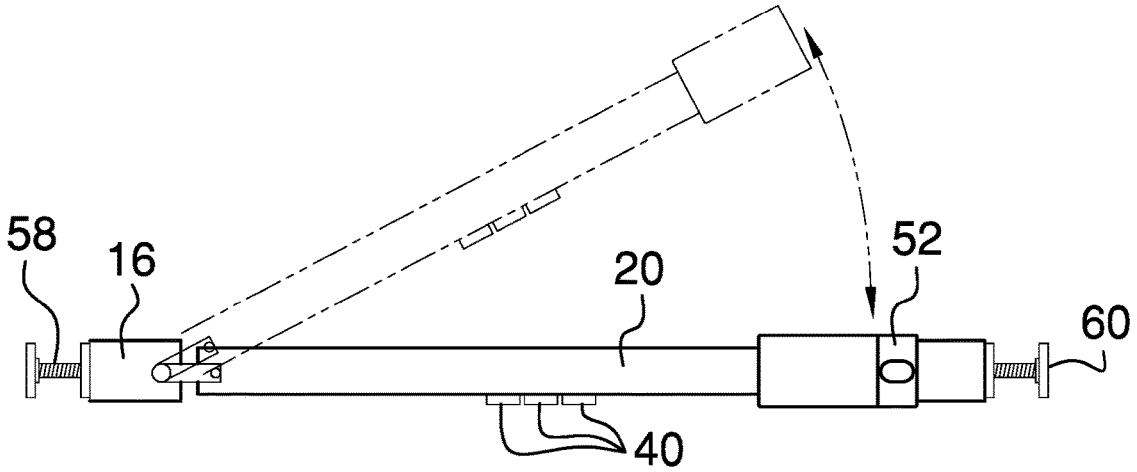
FIG. 3 is a top view of an embodiment of the disclosure.
Figure 4:
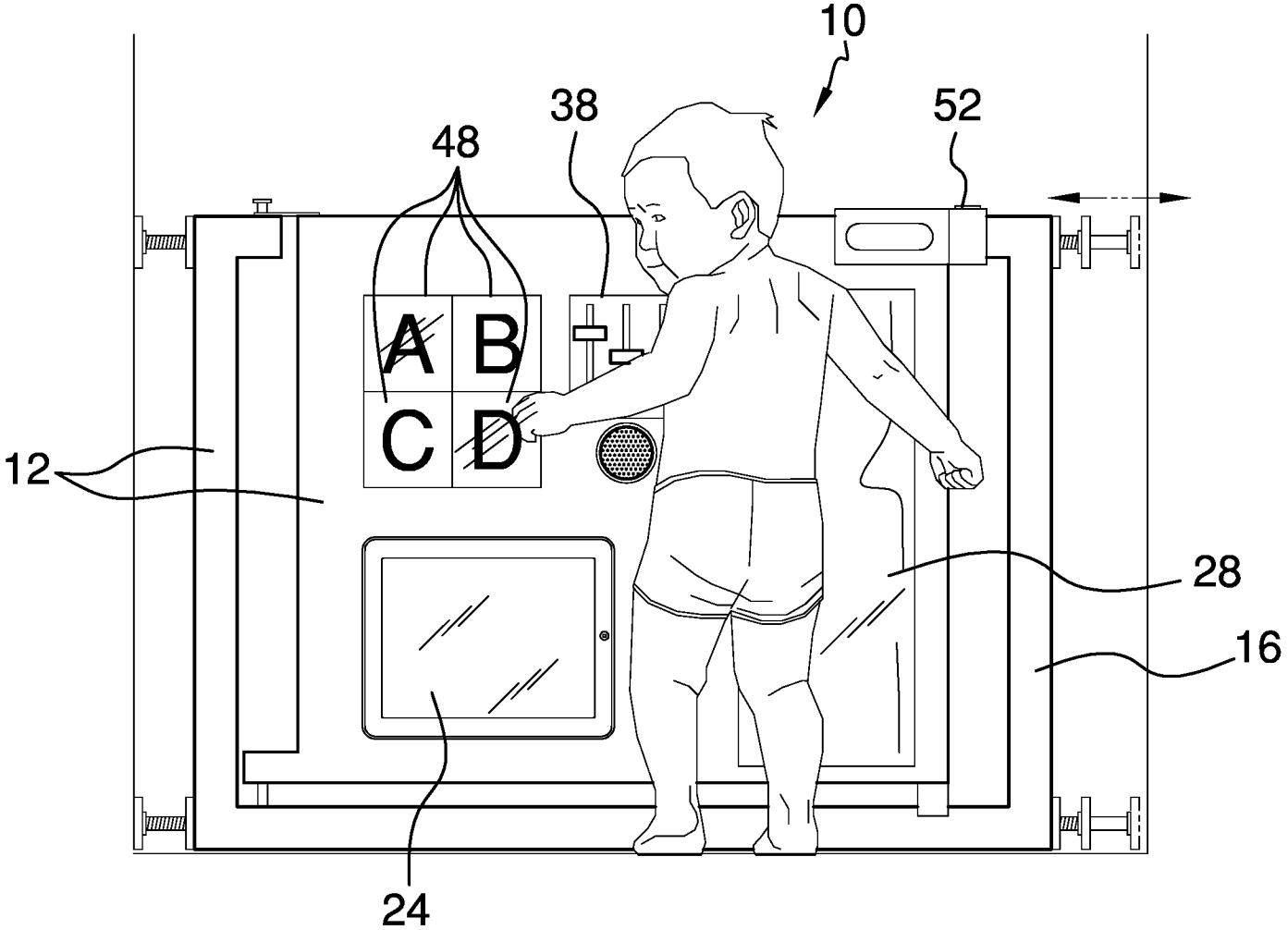
FIG. 4 is an in-use view of an embodiment of the disclosure.
Figure 5:
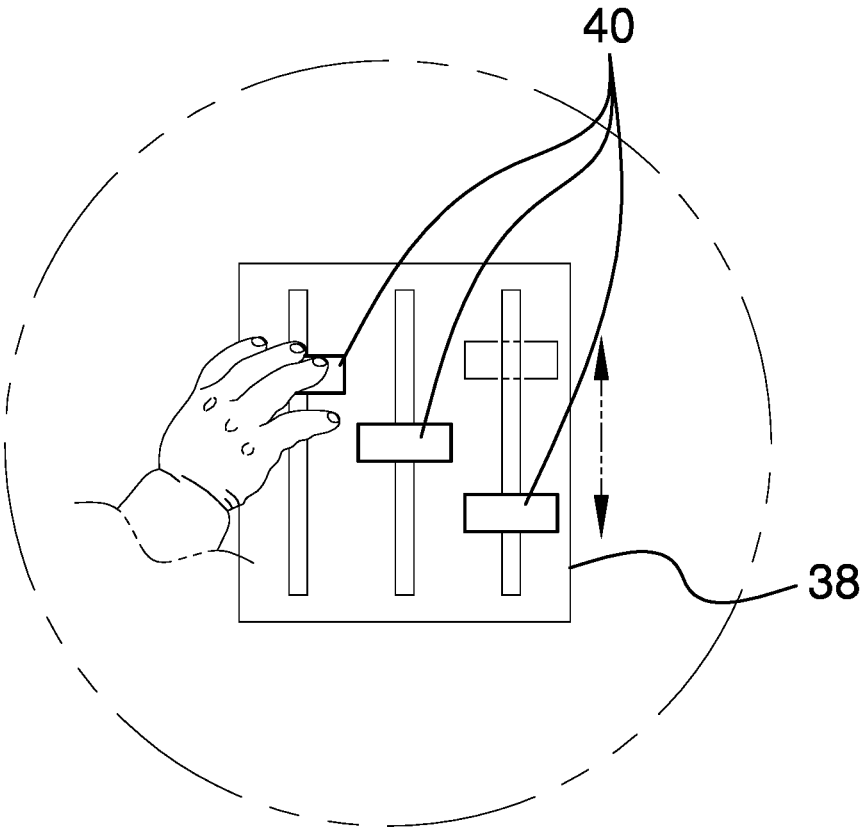
FIG. 5 is a detail view of an embodiment of the disclosure.

With reference now to the drawings, and in particular to FIGS. 1 through 5 thereof, a new gating assembly embodying the principles and concepts of an embodiment of the disclosure and generally designated by the reference numeral 10 will be described.

As best illustrated in FIGS. 1 through 5, the entertainment and gating assembly 10 generally comprises a gate 12 that is configured to selectively couple to opposing elements of a structure that define an opening, such as jambs of a door, to selectively retain a child within a portion of the structure. In one embodiment, the gate 12 comprises a first bar 14 and a pair of second bars 16. Each second bar 16 is coupled to and extends from a respective opposing end 18 of the first bar 14. Each second bar 16 is configured to selectively couple to a respective opposing element of the structure, such as the jamb of the door.

A housing 20 is pivotally coupled to a respective second bar 16. The housing 20 defines an interior space 22 and is substantially rectangularly box shaped. The housing 20 is configured to be pivoted to selectively close the opening to selectively retain the child within the portion of the structure.

At least one entertainment module 24 is coupled to the gate 12. The at least one entertainment module 24 is configured to entertain the child who is retained in the portion of the structure. In one embodiment, the at least one entertainment module 24 is reversibly couplable to the gate 12. The at least one entertainment module 24 is positioned on a first face 26 of the housing 20.

In one embodiment of the invention, the at least one entertainment module 24 comprises a mirror 28. The mirror 28 is nonplanar so that an image which is reflected from the mirror 28 is distorted.

In another embodiment of the invention, the at least one entertainment module 24 comprises an audio module 30 that is configured to broadcast music to the child. In one embodiment, the audio module 30 comprises at least one first battery 32 and a music player 34 that are coupled to the housing 20. The at least one first battery 32 and the music player 34 are positioned in the interior space 22. The music player 34 is operationally coupled to the at least one first battery 32. A speaker 36 is coupled to the first face 26 of the housing 20. The speaker 36 is operationally coupled to the music player 34. The speaker 36 is configured to broadcast the music to the child. A controller 38 is coupled to the first face 26 of the housing 20. The controller 38 is operationally coupled to the music player 34. The controller 38 is configured to issue commands, such as a volume control command and a selection command, to the music player 34. In another embodiment, the controller 38 comprises a set of three toggle bars 40.

In yet another embodiment of the invention, the at least one entertainment module 24 comprises at least one second battery 42 that is coupled to the housing 20 and is positioned in the interior space 22. A tablet 44 is coupled to the first face 26 of the housing 20. The tablet 44 is operationally coupled to the at least one second battery 42. The tablet 44 is touch-enabled so that the tablet 44 is configured to display shapes that are traced on the tablet 44 by the child.

In still yet another embodiment of the invention, the at least one entertainment module 24 comprises at least one screen 46 is coupled to the first face 26 of the housing 20. The at least one screen 46 is operationally coupled to the at least one first battery 32. The at least one screen 46 is configured to selectively display an image, such as a letter and a number, to be viewed by the child. In one embodiment, the at least one screen 46 comprises a set of four displays 48. The set of four displays 48 is operationally coupled to the speaker 36. The set of four displays 48 is touch-enabled. A respective display 48 is configured to display a respective image and to be touched by the child to compel the speaker 36 to broadcast a word that corresponds to the respective image.

A coupler 50 is coupled to an upper corner 66 of the housing 20. The coupler 50 is configured to selectively couple to a respective second bar 16. The coupler 50 is positioned to couple to the respective second bar 16 to secure the housing 20. The gate 12 is configured to close the opening. In one embodiment, the coupler 50 comprises a latch 52.

Each of a plurality of connectors 54 is coupled to a respective second bar 16. The connectors 54 are configured to selectively couple to the opposing elements of the structure, such as the jambs of the door, to couple the gate 12 to the structure. In one embodiment, the plurality of connectors 54 comprises four connectors 54 that are positioned two-apiece on each second bar 16. In another embodiment, each connector 54 comprises a channel 56 and a bolt 58. The channel 56 is positioned in the second bar 16 and is threaded. The bolt 58 is complementary to and is positioned in the channel 56. The bolt 58 is configured to be rotated to be extended from the channel 56 so that a head 60 of the bolt 58 is frictionally coupled to a respective element of the structure to couple the gate 12 to the structure.

A plurality of slots 62 is positioned through a second face 64 of the housing 20. The slots 62 are configured to vent the interior space 22. In one embodiment, the plurality of slots 62 comprises four slots 62 that are positioned proximate to the tablet 44 and four slots 62 that are positioned proximate to the at least one screen 46.

In use, each bolt 58 is configured to be rotated to be extended from an associated channel 56. The head 60 of the bolt 58 is frictionally coupled to the respective element of the structure to couple the gate 12 to the structure. The housing 20 is configured to be pivoted to selectively close the opening. The latch 52 is positioned to couple to the respective second bar 16 to secure the housing 20 to selectively retain the child within the portion of the structure. The image that is reflected from the mirror 28 is distorted. The speaker 36 is configured to broadcast the music to the child. The controller 38 is configured to issue the commands, such as the volume control command and the selection command, to the music player 34. The tablet 44 is configured to display the shapes that are traced on the tablet 44 by the child. The respective display 48 is configured to display the respective image and to be touched by the child to compel the speaker 36 to broadcast the word that corresponds to the respective image.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An entertainment and gating assembly comprising:

a gate configured for selectively coupling to opposing elements of a structure defining an opening for selectively retaining a child within a portion of the structure, said gate comprising:

a first bar, a pair of second bars, each said second bar being coupled to and extending from a respective opposing end of said first bar, each said second bar being configured for selectively coupling to a respective opposing element of the structure, a housing pivotally coupled to a respective said second bar, said housing defining an interior space, said housing being substantially rectangularly box shaped, and wherein said housing is positioned on said respective said second bar such that said housing is configured for pivoting for selectively closing the opening for selectively retaining the child within the portion of the structure;

at least one entertainment module coupled to said gate, said at least one entertainment module comprising an audio module configured for broadcasting music to the child;

wherein said at least one entertainment module is positioned on said gate such that said at least one entertainment module is configured for entertaining the child retained in the portion of the structure said audio module comprising: at least one first battery coupled to said housing and positioned in said interior space and a speaker coupled to said first face of said housing, said speaker being operationally coupled to said music player;

at least one screen coupled to said first face of said housing, said at least one screen being operationally coupled to said at least one first battery, said at least one screen being configured for selectively displaying an image, such as a letter and a number, wherein said at least one screen is positioned on said housing such that said at least one screen is configured for displaying a respective image for viewing by the child; and wherein said at least one screen comprises a set of four displays, said set of four displays being operationally coupled to said speaker, said set of four displays being touch-enabled, wherein said set of four displays is positioned on said housing such that a respective said display is configured for displaying a respective image, wherein said respective said display is configured for touching by the child such that said respective said display is positioned for compelling said speaker for broadcasting a word corresponding to the respective image.

2. The assembly of claim 1, further including said at least one entertainment module being reversibly couplable to said gate.

3. The assembly of claim 1, further including said at least one entertainment module being positioned on a first face of said housing.

4. The assembly of claim 3, further including said at least one entertainment module comprising a mirror, said mirror being nonplanar such that an image reflected from said mirror is distorted.

5. The assembly of claim 1, further including said said audio module further comprising:

a music player coupled to said housing and positioned in said interior space, said music player being operationally coupled to said at least one first battery, a controller coupled to said first face of said housing, said controller being operationally coupled to said music player; and wherein said speaker is positioned on said housing such that said speaker is configured for broadcasting the music to the child, wherein said controller is positioned on said housing such that said controller is configured for issuing commands to said music player.

6. The assembly of claim 1, further including said controller comprising a set of three toggle bars.

7. The assembly of claim 5, further including comprising:

at least one second battery coupled to said housing and positioned in said interior space; and a tablet coupled to said first face of said housing, said tablet being operationally coupled to said at least one second battery, said tablet being touch-enabled such that said tablet is configured for displaying shapes traced on said tablet by the child.

8. The assembly of claim 1, further including a coupler coupled to an upper corner of said housing, said coupler being configured for selectively coupling to a respective said second bar, wherein said coupler is positioned on said housing such that said coupler is positioned for coupling to said respective said second bar for securing said housing such that said gate is configured for closing the opening.

9. The assembly of claim 8, further including said coupler comprising a latch.

10. The assembly of claim 1, further including a plurality of connectors, each said connector being coupled to a respective said second bar, said connectors being configured for selectively coupling to the opposing elements of the structure for coupling said gate to the structure.

11. The assembly of claim 10, further including said plurality of connectors comprising four said connectors positioned two-apiece on each said second bar.

12. The assembly of claim 10, further including each said connector comprising:

a channel positioned in said second bar, said channel being threaded;

a bolt complementary to and positioned in said channel; and wherein said bolt is positioned in said channel such that said bolt is configured for being rotated for extending from said channel such that a head of said bolt is frictionally coupled to a respective element of the structure for coupling the gate to the structure.

13. The assembly of claim 1, further including a plurality of slots positioned through a second face of said housing, wherein said slots are positioned in said housing such that said slots are configured for venting said interior space.

14. The assembly of claim 13, further including said plurality of slots comprising four said slots positioned proximate to said tablet and four said slots positioned proximate to said at least one screen.

15. An entertainment and gating assembly comprising:

a gate configured for selectively coupling to opposing elements of a structure defining an opening for selectively retaining a child within a portion of the structure, said gate comprising:

a first bar, a pair of second bars, each said second bar being coupled to and extending from a respective opposing end of said first bar, each said second bar being configured for selectively coupling to a respective opposing element of the structure, and a housing pivotally coupled to a respective said second bar, said housing defining an interior space, said housing being substantially rectangularly box shaped, wherein said housing is positioned on said respective said second bar such that said housing is configured for pivoting for selectively closing the opening for selectively retaining the child within the portion of the structure;

at least one entertainment module coupled to said gate, wherein said at least one entertainment module is positioned on said gate such that said at least one entertainment module is configured for entertaining the child retained in the portion of the structure, said at least one entertainment module being reversibly couplable to said gate, said at least one entertainment module being positioned on a first face of said housing, said at least one entertainment module comprising:

a mirror, said mirror being nonplanar such that an image reflected from said mirror is distorted, an audio module configured for broadcasting music to the child, said audio module comprising:

at least one first battery coupled to said housing and positioned in said interior space, a music player coupled to said housing and positioned in said interior space, said music player being operationally coupled to said at least one first battery, a speaker coupled to said first face of said housing, said speaker being operationally coupled to said music player, wherein said speaker is positioned on said housing such that said speaker is configured for broadcasting the music to the child, and a controller coupled to said first face of said housing, said controller being operationally coupled to said music player, wherein said controller is positioned on said housing such that said controller is configured for issuing commands to said music player, said controller comprising a set of three toggle bars, at least one second battery coupled to said housing and positioned in said interior space, a tablet coupled to said first face of said housing, said tablet being operationally coupled to said at least one second battery, said tablet being touch-enabled such that said tablet is configured for displaying shapes traced on said tablet by the child, and at least one screen coupled to said first face of said housing, said at least one screen being operationally coupled to said at least one first battery, said at least one screen being configured for selectively displaying an image, wherein said at least one screen is positioned on said housing such that said at least one screen is configured for displaying a respective image for viewing by the child, said at least one screen comprising a set of four displays, said set of four displays being operationally coupled to said speaker, said set of four displays being touch-enabled, wherein said set of four displays is positioned on said housing such that a respective said display is configured for displaying a respective image, wherein said respective said display is configured for touching by the child such that said respective said display is positioned for compelling said speaker for broadcasting a word corresponding to the respective image;

a coupler coupled to an upper corner of said housing, said coupler being configured for selectively coupling to a respective said second bar, wherein said coupler is positioned on said housing such that said coupler is positioned for coupling to said respective said second bar for securing said housing such that said gate is configured for closing the opening, said coupler comprising a latch;

a plurality of connectors, each said connector being coupled to a respective said second bar, said connectors being configured for selectively coupling to the opposing elements of the structure for coupling said gate to the structure, said plurality of connectors comprising four said connectors positioned two-apiece on each said second bar, each said connector comprising:

a channel positioned in said second bar, said channel being threaded, and a bolt complementary to and positioned in said channel, wherein said bolt is positioned in said channel such that said bolt is configured for being rotated for extending from said channel such that a head of said bolt is frictionally coupled to a respective element of the structure for coupling the gate to the structure;

a plurality of slots positioned through a second face of said housing, wherein said slots are positioned in said housing such that said slots are configured for venting said interior space, said plurality of slots comprising four said slots positioned proximate to said tablet and four said slots positioned proximate to said at least one screen; and wherein said bolts are positioned in said channels such that each said bolt is configured for being rotated for extending from an associated said channel such that said head of said bolt is frictionally coupled to the respective element of the structure for coupling the gate to the structure, wherein said housing is positioned on said respective said second bar such that said housing is configured for pivoting for selectively closing the opening, wherein said latch is positioned on said housing such that said latch is positioned for coupling to said respective said second bar for securing said housing such that said gate is configured for closing the opening for selectively retaining the child within the portion of the structure, wherein said mirror is positioned on said housing such that the image reflected from said mirror is distorted, wherein said speaker is positioned on said housing such that said speaker is configured for broadcasting the music to the child, wherein said controller is positioned on said housing such that said controller is configured for issuing the commands to said music player, wherein said tablet is positioned on said housing such that said tablet is configured for displaying the shapes traced on said tablet by the child, wherein said set of four displays is positioned on said housing such that said respective said display is configured for displaying the respective image, wherein said respective said display is configured for touching by the child such that said respective said display is positioned for compelling said speaker for broadcasting the word corresponding to the respective image.

* * * * *